United States Patent [19]

St. Clair

[11] Patent Number: 4,549,329

[45] Date of Patent: Oct. 29, 1985

[54] PORTABLE WET AND DRY SELF-CLEANING VACUUM DEVICE

[76] Inventor: Joseph V. St. Clair, 26 Rockwood Dr., Southington, Conn. 06489

[21] Appl. No.: 629,611

[22] Filed: Jul. 11, 1984

[51] Int. Cl.[4] ..... A47L 7/00

[52] U.S. Cl. ..... 15/353; 15/320; 15/322

[58] Field of Search ..... 15/320, 321, 322, 353

[56] References Cited

U.S. PATENT DOCUMENTS

| | | | |
|---|---|---|---|
| 2,607,067 | 8/1952 | Minerley | 15/320 |
| 2,607,068 | 8/1952 | Minerley | 15/320 |
| 2,693,000 | 11/1954 | Minerley | 15/320 |
| 2,916,761 | 12/1959 | Oberg | 15/322 |
| 3,020,576 | 2/1962 | Gerber | 15/320 |

*Primary Examiner*—Chris K. Moore
*Attorney, Agent, or Firm*—Joseph J. Baker

[57] ABSTRACT

A self-cleaning, portable vacuum device is disclosed for picking up, storing, and subsequently discharging liquid, semi-liquid or dry material. The device includes a housing having an electric motor for driving a vacuum pump which draws the material up a tubular suction member and deposits it in a holding chamber. Means are provided for delivering a cleaning fluid from a self-contained source to the area adjacent and around the end opening of the suction member and subsequently drawn up by the vacuum the entire length of the member to thereby remove and clean any remaining material from the walls thereof and deposit it in the holding chamber.

6 Claims, 5 Drawing Figures

FIG. 1
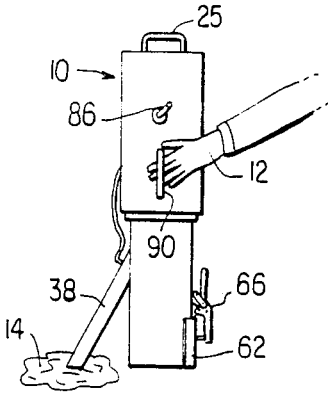
FIG. 2
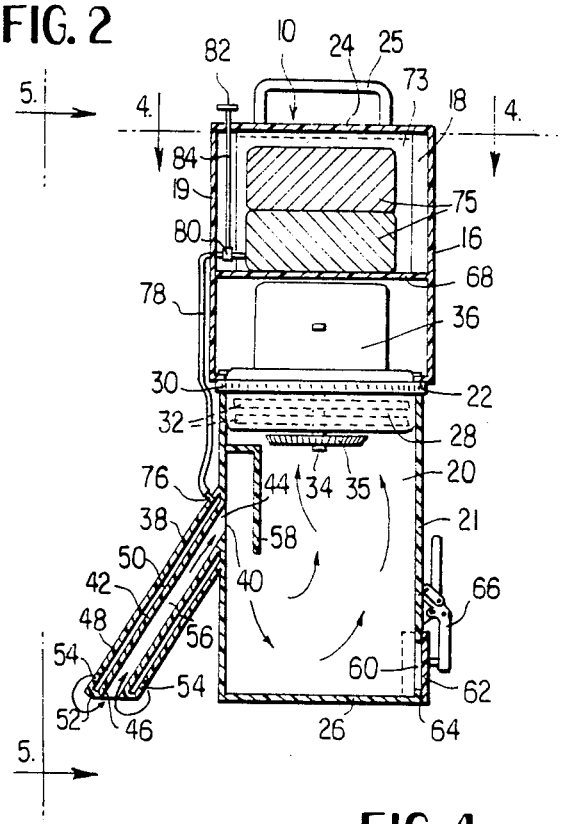
FIG. 3
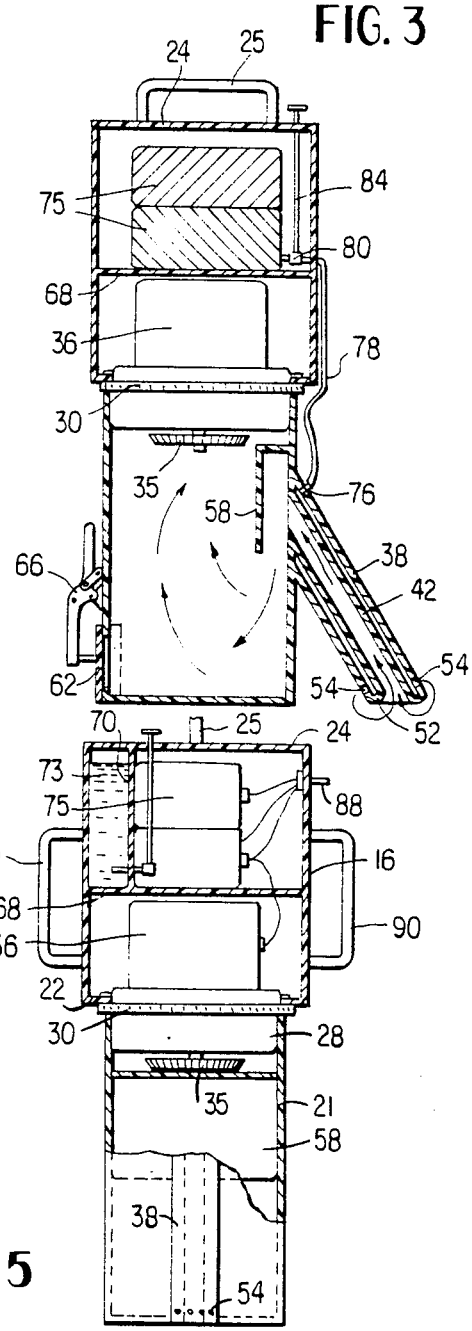
FIG. 4
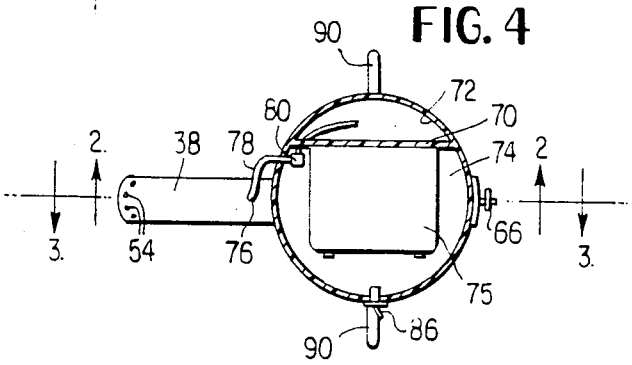
FIG 5

PORTABLE WET AND DRY SELF-CLEANING VACUUM DEVICE

BACKGROUND OF THE INVENTION

This invention relates to cleaning devices and more specifically to a portable vacuum operated device capable of picking up, storing and subsequently discharging liquid, semi-liquid or dry material and has a self-contained means for cleaning the sunction tube after each use if desired.

Applicant is unaware of any portable, vacuum operated cleaning device which is constructed or operates in the manner of the device of the subject invention. Devices for picking up, storing and subsequently discharging liquid or dry material are not new. Typical examples are those shown in U.S. Pat. Nos. 2,306,212 and 3,331,090. These devices are suitable for picking up fluids such as plain water and the like, storing it, and then discharging it when desired. However, they are totally unsuited for picking up and storing dry material or fluids of a liquid or semi-liquid consistency such as human or animal wastes of, for example, urine, feces, vomit and the like as well as substances of a chemical or biological nature having a degree of toxicity associated therewith. This unsuitability of the prior are devices for such uses is primarily due to the fact that no means is provided for cleaning and disinfecting the various parts of the device which have come in contact with the waste or objectionable material thus necessitating disassembly and cleaning of each individual contacted part of the device after each use.

In contrast to the aforedescribed prior art devices with their inherent inability to clean or disinfect themselves, applicant now sets forth in detail his unique device which has a self contained supply of cleaning-/disinfectant fluid that can be used when desired to contact with each part of the device contaminated by the waste material to clean and disinfect same after each use without disassembly of the device.

It is therefore the primary object of the present invention to provide a superior self-cleaning vacuum operated device for picking up wet or dry materials.

It is another object of the present invention to provide a vacuum device which is portable and can be operated on its own self-contained power supply or can be plugged into a conventional electrical outlet.

It is yet another object of the present invention to provide a vacuum device which is capable of picking up, storing and subsequently discharging material such as vomit, animal wastes and the like having a liquid or semi-liquid consistency.

It is a further object of the present invention to provide a vacuum device of the subject type which has its own supply of cleaning, disinfecting fluid that can be drawn around the outer end and up the tubular suction member to thereby cleanse and disinfect the end and walls thereof and deposit the removed waste material in a storage compartment.

It is also a further object of the present invention to provide a vacuum device that can be cleaned by inserting the suction member into a source of water, such as, a toilet bowl, filling the storage compartment to an indicated level, and emptying same.

It is still a further object of the present invention to provide a vacuum device having the aforemention described advantageous objects which is lightweight in construction, is easy to maintain and use, and can be made and sold at a reasonable cost.

Other objects and advantages of the invention will hereinafter appear and for purposes of illustration, but not of limitation, an embodiment of the invention is shown on the accompanying drawings in which:

FIG. 1 is a perspective view of the vacuum device of the present invention,

FIG. 2 is an elevational view in cross-section of the side of the device shown in FIG. 1, FIG. 3 is an elevational view in cross-section of the back side of the device shown in FIG. 1, FIG. 4 is a top view in cross-section taken along the lines 4—4 of FIG. 2, and FIG. 5 is an elevational view in partial cross-section of the rear of the device taken along the lines 5—5 of FIG. 3.

Referring now to the drawing where like characters of reference indicate like elements in each of the several views, numeral 10 in FIG. 1 refers generally to the portable vacuum cleaning device of the present invention held in the hand 12 of a user and adapted to pick up, store and subsequently discharge dry, liquid or semi-liquid material 14. The device 10, because of its unique, self-contained cleaning means (to be fully described later) is particularly suited to pick up animal or human wastes such as feces, vomit and the like as well as substances of a toxic chemical or biological nature and its use in this regard will be described herein. Further, because the size of the device 10 enables it to be held in one hand during transport and use, the storage compartment can be easily emptied and flushed out when desired. The device can also be stored in a convenient place next to where it is most frequently needed.

More specifically, the device 10 as can best be seen by referring to FIGS. 2-5 includes a substantially cylindrical, tubular-shaped housing 16 preferably made of a rigid plastic-like material. The housing is divided into an upper chamber 18 formed by a wall 19 and a lower or watertight storage chamber 20 formed by wall 21 by means of a partition 22 intermediate the ends of the housing 16. The upper chamber 18 has a top end closure member 24 with a handle 25 and the lower chamber 20 has a bottom end closure member 26 which is in watertight sealing engagement with the housing 16 to form a tank for holding a quantity of liquid or semi-liquid material 14. A fan 28 for creating a suction in the lower chamber 20 is mounted on the partition 22 and is exhausted to the atmosphere through vent holes 30 which extend around the periphery of the housing 16. The fan 28 comprises one or more sets of fan blades 32 (shown in phantom lines) connected to a common shaft 34. A DC electric motor 36, which in one embodiment requires twenty-four volts, is operatively connected to drive the shaft 34 and fan blades 32 to create the aforementioned suction in lower chamber 20. The source of electric current to run the motor 36 can be supplied externally or from a self-contained source as will be more fully described later. Also connected to shaft 34 below fan blades 32 is a centrifugal separator fan 35 manufactured by the Rex Air Corp. of Troy, Michigan and disclosed in U.S. Pat. No. 2,188,031. The separator fan 35 permits air to pass through it but prevents water from passing in the event the device 10 is inadvertenly filled too full.

A tubular suction member 38 in the form of a nozzle extends downward from an opening 40 into and spaced a distance above the bottom 26 of lower chamber 20.

The suction member 38 serves to carry the liquid or semi-liquid material to be picked up to the lower chamber. The nozzle 38 comprises an inner cylindricalshaped tubular member 42 having one end 44 in communication with the opening 40 and the other end 46 extends to and is connected to the outer tubular member 48 at the end thereof. The outer tubular member 48 is cylindrical in shape and is also concentric with and, in the embodiment shown, substantially co-extensive with inner tubular member 42. The outer tubular member 48 has an inner diameter which is approximately one-eighth of an inch greater than the outer diameter of the inner tubular member 42 to thereby provide a space 50 between the members 42, 48 to permit the passage of a cleaning and disinfecting fluid to the end of the tubular members. The outer tubular member 48 extends to and is joined to end 46 at curved end portion 52 to seal the end space 50 to prevent any fluid from escaping from between members 42, 48.

A plurality of spaced apart small holes 54 are formed through outer tubular member 48 into space 50 adjacent to and around the curved portion 52 to permit fluid to exit as will be more fully described later. As the waste material to be picked up is drawn up through passageway 56 in inner tubular member 42 and exits opening 40 it strikes a deflection shield 58 which is secured to the wall 21 of lower chamber 20 and the waste material is directed downward. The deflection shield 58 thus prevents any of the waste material from being drawn into the suction fan 28. The lower chamber 20 also has an opening 60 through wall 21 adjacent the bottom 26 for emptying the chamber when desired. The opening 60 is normally sealed by a cover member 62 having gasket material 64 adjacent the edge to insure a watertight seal with the wall 21. The cover 62 is pressed toward and maintained against the wall 21 by means of a conventional toggle-type actuated clamp 66.

The upper chamber 18 has a horizontal partition 68 above the electric motor 36 which extends to the wall 19 and a vertical partition 70 which further divides the upper chamber 18 into a reservoir 72 for holding a quantity of cleaning/disinfectant fluid 73 and an area 74 for storage of a plurality of electric-batteries 75 preferably of the rechargable type. A nipple 76 is provided which extends through outer tubular member 48 into communication with space 50. A hose 78 extends from the nipple 76 to the outlet side of a shut-off valve 80 mounted in area 74. The inlet side of the valve 80 is connected by hose to the bottom of reservoir 72 through vertical partition 70. Actuation of the valve 80 is controlled by means of a knob 82 connected to the valve 80 by means of a shaft 84 extending through top 24. The valve 80 controls the flow of fluid 73 from the reservoir 72 to the space 50 in suction member 38 to be hereinafter more fully described with regard to the description of the operation of the device. A switch 86, mounted on the wall 19, is provided for controlling energization of the electric motor 36 by the batteries 75 and another switch 88 is provided for controlling charging current to the rechargable batteries 75 from an external source (not shown). Handles 90 are provided on opposite sides of wall 19 to facilitate handling of the device. Another embodiment of the device 10 is contemplated where it is desired to reduce the overall weight of the device. This is achieved by eliminating the batteries 75 and connecting the electric motor directly to an external source of electric current by a cord.

OPERATION

In operation, the switch 86 is thrown starting the electric motor 36, fan 28 and separator fan 35. A suction is thus created in lower storage chamber 20 which in turn causes a suction in passageway 56 of nozzle 38. At this time, the valve 80 is moved to its open position by means of knob 82 allowing cleaning/disinfecting fluid 73 to flow by the force of gravity through hose 78 into the space 50 around and down inner tubular member 42 to its end 46. The fluid is then caused to exit holes 54, run down to the end 54 and be drawn up passageway 56 (See arrows) to thereby clean around the periphery of end 54. As the fluid 73 is drawn up passageway 56 it coats it with water and disinfectant so that there is cleansing and no clogging or sticking as different materials are picked up. The end 52 of nozzle 38 is then placed adjacent the liquid or semi-liquid waste material 14 where it is caused to be drawn up passageway 56 with the fluid 73, through opening 40 in lower chamber wall 21 and against deflection shield 58. The waste material 14 drops from the deflection shield 58 by gravity into the lower part of the storage chamber 20 where it is held until emptied and any accompanying air would be drawn up through separation fan 35 and fan 28 (see arrows) to be vented out holes 30. After the last of the waste material 14 is drawn up passageway 56 energization of the electric motor 36 is maintained and the valve 80 is left opened for a brief period. As fluid 73 only is drawn up passageway 56 it cleans and disinfects the sidewalls thereof and deposits any remaining waste remnants in the storage chamber 20. Additional cleansing of the passageway 56 and other parts can be achieved by closing valve 80, inserting the end 52 in a source of water, such as a toilet bowl, drawing in the water until a predetermined level is reached in lower chamber 20, and discharging same through opening 60. This procedure can be repeated after the toilet is flushed to bring in fresh water. Actuation of clamp 66 enables cover member 62 to be removed permitting emptying and cleaning of the storage chamber 20. An external charging device (not shown) can then, if desired, be connected by switch 88 to recharge the batteries 75.

Applicant has thus described in detail his novel, self-cleaning portable device for picking up, storing and subsequently discharging dry, liquid or semiliquid waste material. It being understood, of course, that numerous changes in details of construction, arrangement and operation may be effected without departing from the spirit of the invention, especially as defined in the appended claims.

What I claim is:

1. A self-cleaning, portable vacuum device for picking up, storing and subsequently discharging dry, liquid, or semi-liquid material comprising:

(a) an elongate tubular housing member having a top closure member covering one end, a bottom closure member covering the other end, and a partition intermediate said ends dividing said housing into an upper chamber and lower chamber, (b) an air pump and a drive motor therefore mounted in said lower compartment, said air pump having an inlet opening into said lower compartment and an outlet opening venting to the atmosphere, (c) a tubular suction member extending outwardly from said housing, such suction member having one end adjacent an opening through said housing into said lower chamber and the outer end adapted to contact said material to be picked up, and (d) means for introducing a cleaning fluid into said tubular suction member to clean and lubricate same as said material is drawn up said suction member and deposited in said lower chamber by the vacuum created by said air pump.

2. A self-cleaning vacuum device as set forth in claim 1 further comprising means positioned in said lower compartment opposite said opening through said housing for deflecting said material as it passes through said opening into said lower compartment.

3. A self-cleaning vacuum device as set forth in claim 1 further comprising an opening through said housing into said lower compartment adjacent said bottom end closure member for discharging said material accumulated in said lower compartment, and means for covering said discharge opening in liquid-tight sealing engagement with said housing member.

4. A self-cleaning vacuum device as set forth in claim 1 wherein said upper chamber is divided into a first watertight compartment for storing a quantity of said cleaning fluid and a second compartment for storing at least one battery for energizing said drivemotor.

5. A self-cleaning vacuum device as set forth in claim 4 wherein said means for introducing a cleaning fluid into said suction member comprises:

(a) an outer tubular member spaced from and concentric with said tubular suction member to provide a passage for said cleaning fluid, (b) an inlet opening through said outer tubular member for introducing said cleaning fluid to said passage and a discharge opening adjacent to said other end of said tubular suction member, (c) conduit means connected to said inlet opening and extending to said compartment containing said cleaning fluid, and (d) valve means for controlling the flow of said cleaning fluid in said conduit means from said compartment to said inlet opening.

6. A self-cleaning vacuum device as set forth in claim 1 further comprising means connected to said air pump and drive motor for preventing fluid from entering said air pump in the event said lower chamber is overfilled.

* * * * *